US007328899B2

(12) United States Patent
Wulf et al.

(10) Patent No.: US 7,328,899 B2
(45) Date of Patent: Feb. 12, 2008

(54) DEVICE FOR GUIDING SHEETS

(75) Inventors: Peter Wulf, Köln (DE); Edgar Dörsam, Obertshausen (DE); Frank Seidel, Dreieich (DE); Rainer Gebhardt, Mühlheim (DE); Udo Trillig, Offenbach (DE); Thomas Litterst, Weil am Rhein (DE); Thomas Ludwig, Weil am Rhein (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 302 days.

(21) Appl. No.: 10/332,829

(22) PCT Filed: Jun. 19, 2001

(86) PCT No.: PCT/EP01/06900

§ 371 (c)(1),
(2), (4) Date: Jan. 4, 2004

(87) PCT Pub. No.: WO02/07977

PCT Pub. Date: Jan. 31, 2002

(65) Prior Publication Data

US 2004/0212146 A1 Oct. 28, 2004

(30) Foreign Application Priority Data

Jul. 12, 2000 (DE) ..... 100 33 838

(51) Int. Cl.
*B41L 21/02* (2006.01)

(52) U.S. Cl. ..... 271/276; 101/415.1

(58) Field of Classification Search ..... 399/388, 399/390, 303, 305, 310, 312, 297; 271/275, 271/276; 101/407, 475, 415.1; 347/101, 347/104

See application file for complete search history.

(56) References Cited

U.S. PATENT DOCUMENTS

| | | | | |
|---|---|---|---|---|
| 3,172,657 | A * | 3/1965 | Gotlieb | 271/275 |
| 3,174,748 | A * | 3/1965 | Roberts et al. | 271/8.1 |
| 3,240,933 | A * | 3/1966 | Reinke | 250/324 |
| 3,323,794 | A * | 6/1967 | Gotlieb | 271/277 |
| 3,341,195 | A | 9/1967 | Brandt et al. | |
| 3,506,259 | A * | 4/1970 | Caldwell et al. | 271/276 |
| 3,695,756 | A * | 10/1972 | Smith | 399/398 |

(Continued)

FOREIGN PATENT DOCUMENTS

DE 12 86 051 B 1/1969

*Primary Examiner*—Patrick Mackey
*Assistant Examiner*—Jeremy Severson
(74) *Attorney, Agent, or Firm*—Leydig, Voit & Mayer, Ltd.

(57) ABSTRACT

An apparatus for fixing a sheet on the surface of an electrically conductive cylinder of a printing machine for processing sheets, in particular, a sheet-fed offset printing machine. The apparatus includes an electrode that extends over the width of the cylinder for creating an electric field for adhering the sheet to the surface of the cylinder and an air directing device for directing pressurized air streams against the sheet and preliminary positioning the sheet onto the cylinder prior to being acted upon by the electric field. Various alternative embodiments of the sheet fixing apparatus are disclosed.

10 Claims, 5 Drawing Sheets

U.S. PATENT DOCUMENTS 3,784,190 A * 1/1974 Crawford ..... 271/309
3,819,261 A * 6/1974 Ogawa ..... 399/130
3,851,962 A * 12/1974 Van Vioten ..... 399/316
4,060,238 A * 11/1977 Simeth ..... 271/276
4,169,673 A * 10/1979 Sato et al. ..... 399/317
4,202,542 A * 5/1980 Lammers et al. ..... 271/276
4,252,307 A * 2/1981 Korte ..... 271/4.01
4,384,524 A * 5/1983 Simeth et al. ..... 101/232
4,395,949 A * 8/1983 Jeschke ..... 101/420
4,869,166 A * 9/1989 Mathes ..... 101/230
4,930,414 A * 6/1990 Wirz ..... 101/183
5,156,090 A * 10/1992 Wirz ..... 101/142
5,398,925 A * 3/1995 Zeltner ..... 271/276
5,655,449 A * 8/1997 Henn et al. ..... 101/232
5,979,318 A * 11/1999 Helmstadter ..... 101/232
6,470,798 B1 * 10/2002 Hiwatashi et al. ..... 101/231
6,561,508 B2 * 5/2003 Helmstadter et al. ..... 271/226
6,619,201 B1 * 9/2003 Becker et al. ..... 101/230
6,626,109 B2 * 9/2003 Kundgen et al. ..... 101/477
6,640,707 B2 * 11/2003 Frankenberger et al. .... 101/232
7,000,917 B2 * 2/2006 Helmstadter et al. ..... 271/276
2001/0046389 A1 * 11/2001 Kuribayashi et al. ..... 399/45

* cited by examiner

DEVICE FOR GUIDING SHEETS

DEVICE FOR GUIDING SHEETS

FIELD OF THE INVENTION

The present invention relates generally to printing machines, and more particularly to affixing and adhering sheets to cylinders during transfer through the printing machine.

BACKGROUND OF THE INVENTION

In sheet-fed offset printing machines, the sheets to be printed are transported through the printing gap or nip formed between the rubber blanket cylinder and the counter-pressure cylinder by cylinders that are equipped with grippers. The transport of sheets between the printing stations also is carried out by cylinders or drums containing gripping devices. In order to guide the sheets onto the cylinders or drums without undesirable fluttering, sheet guiding apparatuses are provided at numerous locations in the printing machines. Such sheet guiding apparatuses guide the sheets onto the cylinder surfaces or metal guides by means of blasting air and/or suction air.

In order to ensure an uninterrupted printing process, it is important that the sheets being introduced into a printing gap, such as between a counter-pressure cylinder and a rubber blanket cylinder, lie on the cylinder in a precisely positioned fashion, and that this position is not changed while the sheets pass through the printing gap. A variety of sheet guiding apparatuses that operate by means of blasting or forced air have been developed for this purpose. In these devices, the sheet is pressed onto the cylindrical surface of the counter-pressure cylinder by means of the blasting air. However, a disadvantage of such sheet guiding apparatuses is that the components of the sheet guide, such as air directing tubes, cannot extend sufficiently far into the space between the counter-pressure cylinder and the rubber blanket cylinder for easy direction of the air. The jets of blasting air consequently must be precisely aligned in order to achieve the desired effect of fixing the sheet in place. It also is disadvantageous that the tendency for sheets to flutter usually increases with an increased pressure of the blasting air, in particular, when processing thin sheets.

Another problem arises if the rubber blanket cylinder is put down relative to the counter-pressure cylinder in a particular printing station, i.e., the sheet situated on the counter-pressure cylinder needs to be transported through the gap at the location without contacting the rubber blanket cylinder. Any contact between the sheet that was printed in preceding printing stations and the surface of the rubber blanket cylinder must be avoided because resulting smearing would lead to wasted sheets.

A blasting air device for fixing a sheet on a counter-pressure cylinder is known from DE 197 15 964 C1. In this device, the jets of blasting air are timed, i.e., the blasting air only acts upon the sheet while it passes through a respective section.

It also is known to fix the position of a sheet situated on a cylinder or another surface by means of electrostatic forces. In the apparatus shown in EP 0 737 572 B1, such an electrostatic device serves for holding sheets situated on a cylinder while they are printed by means of an auxiliary printing device (i.e. a laser printer or inkjet printer).

An electrostatic sheet holding device arranged in the region of the printing gap between a counter-pressure cylinder and a rubber blanket cylinder also is known from U.S. Pat. No. 3,174,748. That device includes a rod that extends over the entire format width. This means that the sheet passes through a gap formed between the rod-shaped electrode and the surface of the counter-pressure cylinder before it is introduced into the printing gap.

In electrostatic devices, the forces that hold the sheets in position are created by the electrically insulating sheet material in connection with an electric field and a charge polarization. In such case, an electric field is created on the surface of the sheet that lies on the counter-pressure cylinder, and an electric charge is generated that causes an electrostatic force between the sheet and the printing cylinder.

One disadvantage in such electrostatic sheet guiding apparatuses is that it is only possible to fix a sheet in position that already lies placidly on the cylinder. In addition, certain geometric conditions also have to be observed such that the arrangement of the electrode in the gap between the rubber blanket cylinder and the counter-pressure cylinder is restricted.

OBJECTS AND SUMMARY OF THE INVENTION

It is an object of the present invention to provide a relatively simple and reliable electrostatic sheet guidance apparatus for a sheet-fed printing machine which is adapted for enabling improved printing quality.

In carrying out the invention, a pneumatic sheet guiding apparatus is combined with an electrostatic device. The blasting air of this sheet guiding apparatus presses the sheet onto the surface of the cylinder such that it placidly lies on the cylinder surface and can then be permanently fixed in position by means of electrostatic forces. The electrostatic device is arranged downstream of the pneumatic sheet guiding apparatus that operates with blasting air, in relation to the transport direction of the material to be printed.

According to the invention, the sheet is charged by means of an electrode before it is introduced into the printing gap. For this purpose, the electrode is arranged a short distance (such as 10-40 mm) from the grounded counter-pressure cylinder. The electric field being created between the electrode and the cylinder surface, as well as the high voltages at the electrode tips, result in an excess number of charge carriers (positive or negative depending on the charge of the electrode) on the surface of the sheet material which faces the electrode. An immediate equalization of the electrically neutral cylinder surface is prevented by the insulating properties of the sheet material. This causes an electric field that exerts holding forces between the charged sheet surface and the neutral cylinder. Since the time for regaining charge equilibrium is similar to the time during which the sheet lies on the cylinder, the charge remains effective even when the sheet is no longer directly situated underneath the electrode. In this respect, it has been determined that the adherence of the sheet improves proportionally with the resistance of the sheet material.

The air blasting device that is arranged upstream of the sheet guiding device, in relation to the sheet transport direction, positions and smooths out the sheet before it is fixed on the surface of the counter-pressure cylinder by the high electrostatic forces. According to one preferred embodiment of the invention, the electrode is integrated into the air blasting device.

The sheet guiding apparatus according to the invention causes the sheet to initially pass the air blasting device such that it is pressed against the surface of the cylinder and smoothed out thereon. Since the forces exerted upon the sheet by the air blasting device are not excessively high, it is possible to slightly correct the position of the sheet before it assumes its final position in which it is fixed by the electrostatic device.

The air blasting device arranged upstream of the electrostatic device, or a part of the blasting device into which the electrostatic device is integrated, preferably has a concave contour on the side that faces the surface of the cylinder, in which the air outlet openings are arranged. This causes individual jets of blasting air to impact on the cylinder surface and consequently the sheet with a slight incline due to the corresponding curvature of the concave surface. This causes the sheet to be smoothed out and pressed against the cylinder by the jets.

Since electrically conductive materials cannot be used in the immediate vicinity of an electrostatic electrode, at least part of the blasting device according to the invention which accommodates the electrode is manufactured of a non-conductive material, preferably plastic.

The sheet fixing apparatus of the present invention can take different forms. According to one embodiment, rod-shaped electrode may be surrounded by two air blasting devices in the form of tubes, wherein a third blasting device in the form of a blasting box with a concave air outlet surface is arranged upstream of the two above-mentioned blasting devices, as viewed in the sheet transport direction.

According to another embodiment, the rod-shaped electrode is embedded in a hollow plastic profile. This hollow plastic profile may be provided with compressed air and includes air outlet openings. This also results in the discharge of air upstream and downstream of the rod-shaped electrode as in the above-mentioned embodiment.

In another embodiment of the invention, an integral air blasting box in the form of a hollow profile is used, wherein this blasting box accommodates the rod-shaped electrode on the side that faces the cylinder guiding the sheet. In this case, the region situated upstream of the electrode preferably is in the form of a concave surface with air outlets.

In another embodiment of the invention, the air blasting device is in the form of a box that accommodates the electrode and the air blasting tubes that laterally flank this electrode.

In yet another embodiment of the invention, the rod-shaped electrode is merely surrounded by two blasting tubes such that air is able to act upon the sheet situated on the cylinder upstream and downstream of the electrode, as viewed in the sheet transport direction.

Other objects and advantages of the invention will become apparent upon reading the following detailed description and upon reference to the drawings, in which:

Figure 1:
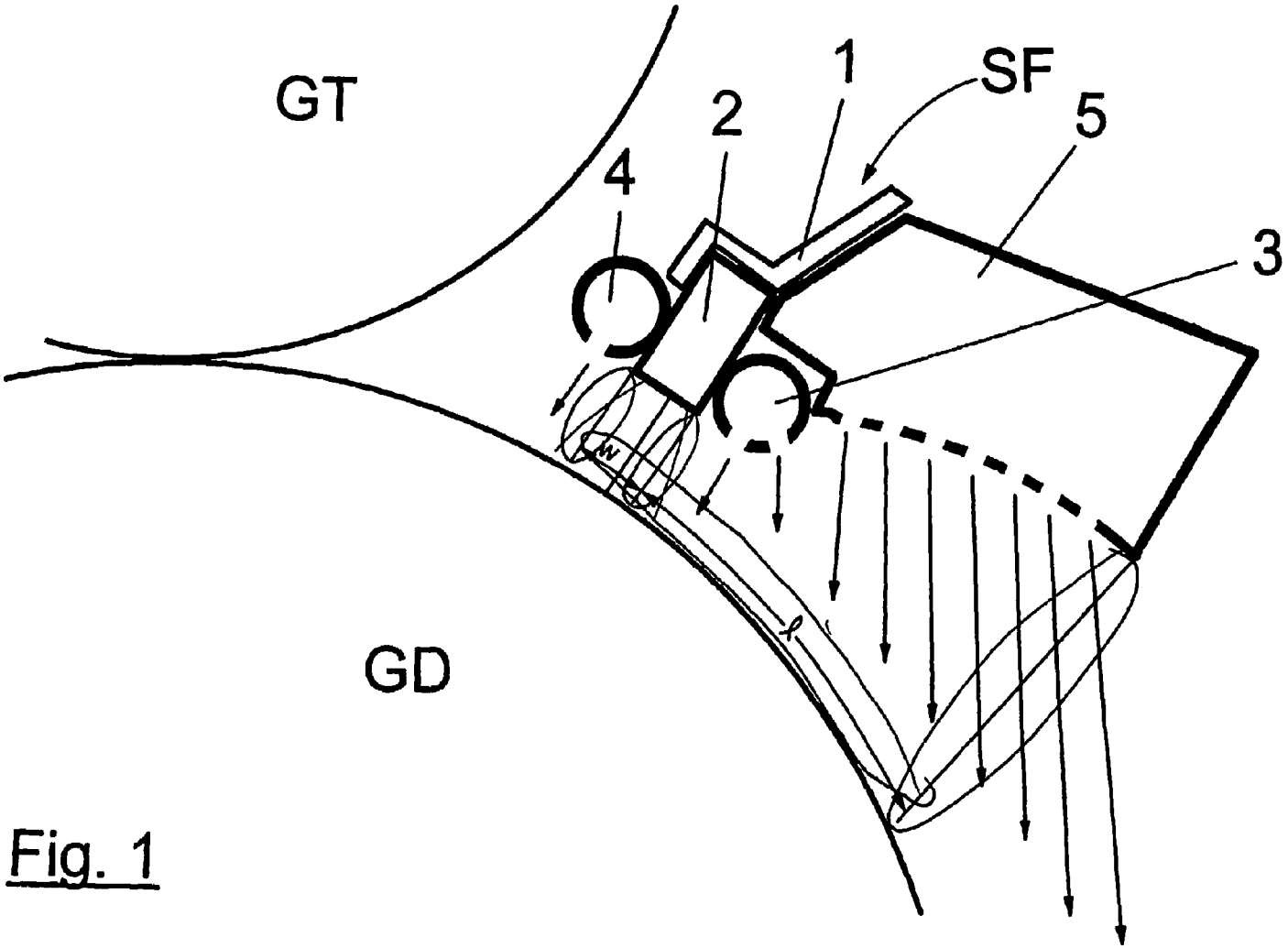
FIG. 1 is a partially diagrammatic side elevational view of a sheet-fed printing press having a sheet fixing apparatus in accordance with the invention, which includes a pair of air directing or blasting tubes, an electrode interposed therebetween, and an upstream air directing or blasting box.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Figure 5:
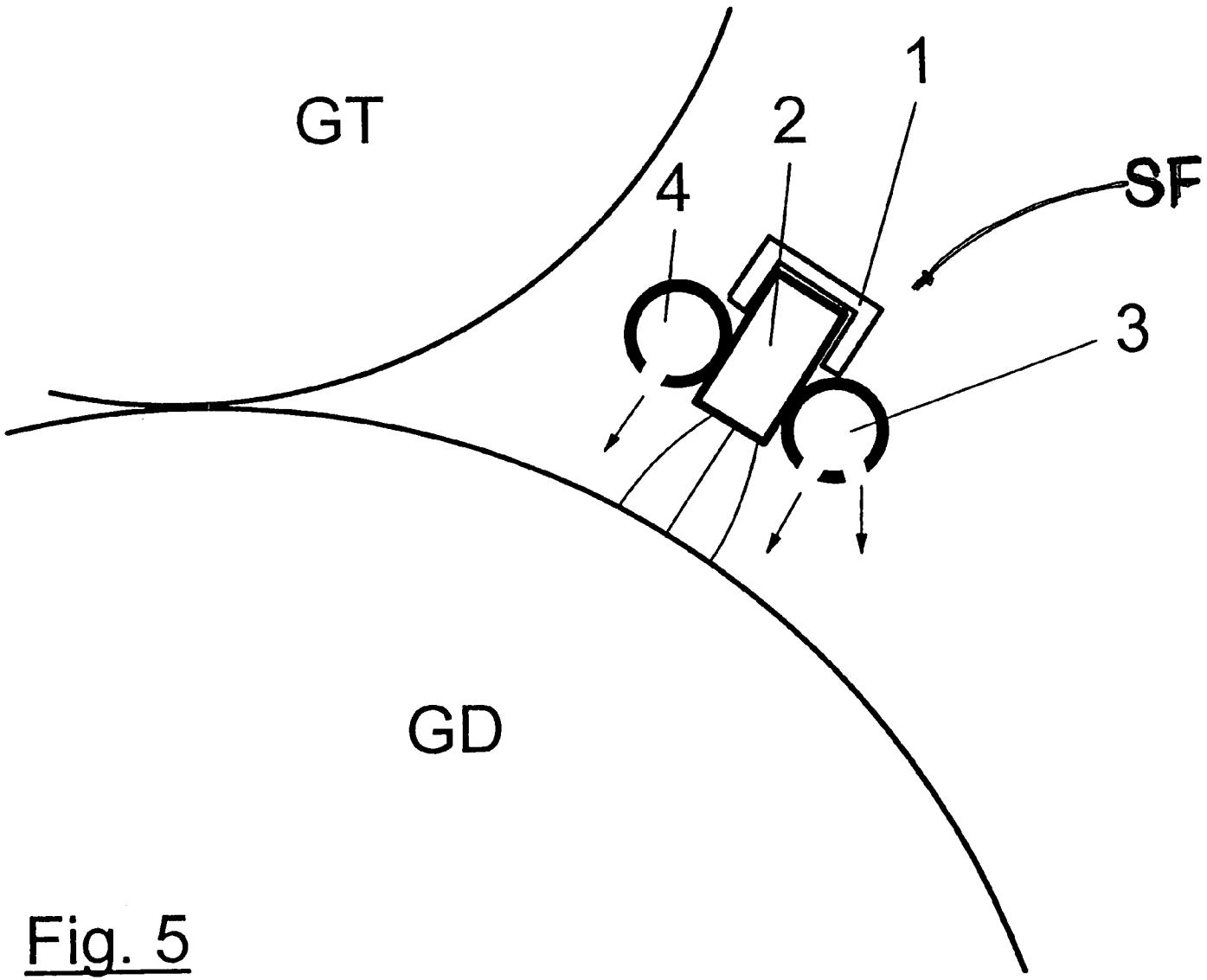
FIG. 5 is a side elevational view of a simplified embodiment of the invention in which an electrode is disposed between adjacent upstream and downstream air directing or blasting tubes.

Referring now more particularly to FIG. 5 of the drawings, there is shown part of a printing station of a sheet-fed offset printing machine having a sheet fixing apparatus in accordance with the invention. The illustrated printing station includes a counterpressure cylinder GD, and a rubber blanket cylinder GT which define a printing gap or nip therebetween. A sheet to be printed is positioned on and carried by the surface of the counterpressure surface GT as it is transferred to and through the printing gap. A sheet fixing apparatus SF is provided for firmly positioning the sheet onto the counterpressure cylinder prior to transport through the printing gap.

In accordance with the invention, the sheet affixing apparatus comprises an air directing device for imparting air currents on the sheet in a direction for preliminary positioning the sheet onto the counterpressure cylinder and a downstream electrode for creating an electrical charge for firmly affixing and adhering the sheet onto the counterpressure cylinder prior to reaching the printing gap. To this end, in the illustrated embodiment, the sheet fixing apparatus SF includes a beam-like carrier 1 that extends over the width of the counterpressure cylinder GD and supports a rod-shaped electrode 2 on a side thereof which faces the counterpressure cylinder GD and which is operable, in a known manner, for directing an electrical field in a direction toward the sheet for attracting the sheet to the grounded counterpressure cylinder GD. The electrode 2 is disposed in predetermined spaced relation to the surface of the counterpressure cylinder GD upstream of the printing nip.

In carrying out the invention, the sheet fixing device includes an air directing device for directing pressurized air currents against the sheet upstream of the electrode 2 for preliminary positioning the sheet onto the counterpressure cylinder prior to being exposed to the electric field of the electrode. By reason of the preliminary positioning of the sheet onto the counterpressure cylinder by the air directing device, the electric field generated by the electrode 2 is adapted for more effective and precise adherence of the sheet onto the counterpressure cylinder GD prior to printing. In the embodiment illustrated in FIG. 5, the air directing device includes an air directing or blasting tube 3 mounted adjacent an upstream side of the electrode 2 for directing air currents downwardly and slightly in an upstream direction, in relation to the direction of sheet transfer. In this embodiment, a second air blasting tube 4 also is positioned on a downstream side of the electrode 2, for directing an air current which further stabilizes and adheres the sheet onto the counter-pressure cylinder GD prior to transfer through the printing gap or nip. The air blasting tubes 3, 4 in this case each have a plurality of openings on the side facing the counterpressure cylinder GD, such that pressurized air supplied to the blasting tubes 3,4, can be discharged in a predetermined direction relative to the sheet being positioned on and carried by the counterpressure cylinder GD.

As will be understood by a person skilled in the art, the sheet to be printed which is situated on the surface of the counterpressure cylinder GD will be first pressed onto the surface of the counterpressure cylinder GD by the air currents generated by the blasting tube 3, as indicated by the narrowed lines, and will be smoothed out onto the cylinder as it is moving in its transport direction. The electric field intensity generated by the electrode 2, indicated by the thin lines emerging from the electrode, act to securely affix and adhere the sheet onto the counterpressure cylinder GD prior to printing. Air current produced downstream of the electrode 2 by the air blasting tube 4, which is simultaneously applied with pressurized air, directs air currents that additionally press the sheet onto the surface of the counterpressure cylinder GD.

An alternative embodiment of sheet fixing device in accordance with the invention is shown in FIG. 1, which in addition to an electrode 2 and upstream and downstream air directing or blasting tubes 3, 4, includes an upstream air blasting box 5 arranged upstream of the electrode 2 and air directing tubes 3, 4. The air directing or blasting box 5 in this case is mounted on an upwardly extending arm of the cross beam 1 which also supports the electrode 2 and air blasting tubes 3, 4. Similar to the electrode 2 and air blasting tubes 3, 4, the blasting box extends over the format width of the machine.

The air blasting box 5, as depicted in FIG. 1, has a concave surface with a series of air outlet openings on the side that faces the surface of the counterpressure cylinder GD. The upstream portion of the air directing device, comprising the tube 3 and the air blasting box or plenum 5, extends a circumferential width the circumferential width w of the electrode bar 2. When pressurized air is supplied to the interior of the blasting box, air currents are produced, as indicated by the arrows. These air currents or jets further act on the sheet upstream of the air currents from the blasting tube 3 to facilitate flutter-free preliminary positioning of the sheet onto the counterpressure cylinder GD prior to the sheet passing beneath the electrode 2 and the electric field generated therefrom.

Figure 2:
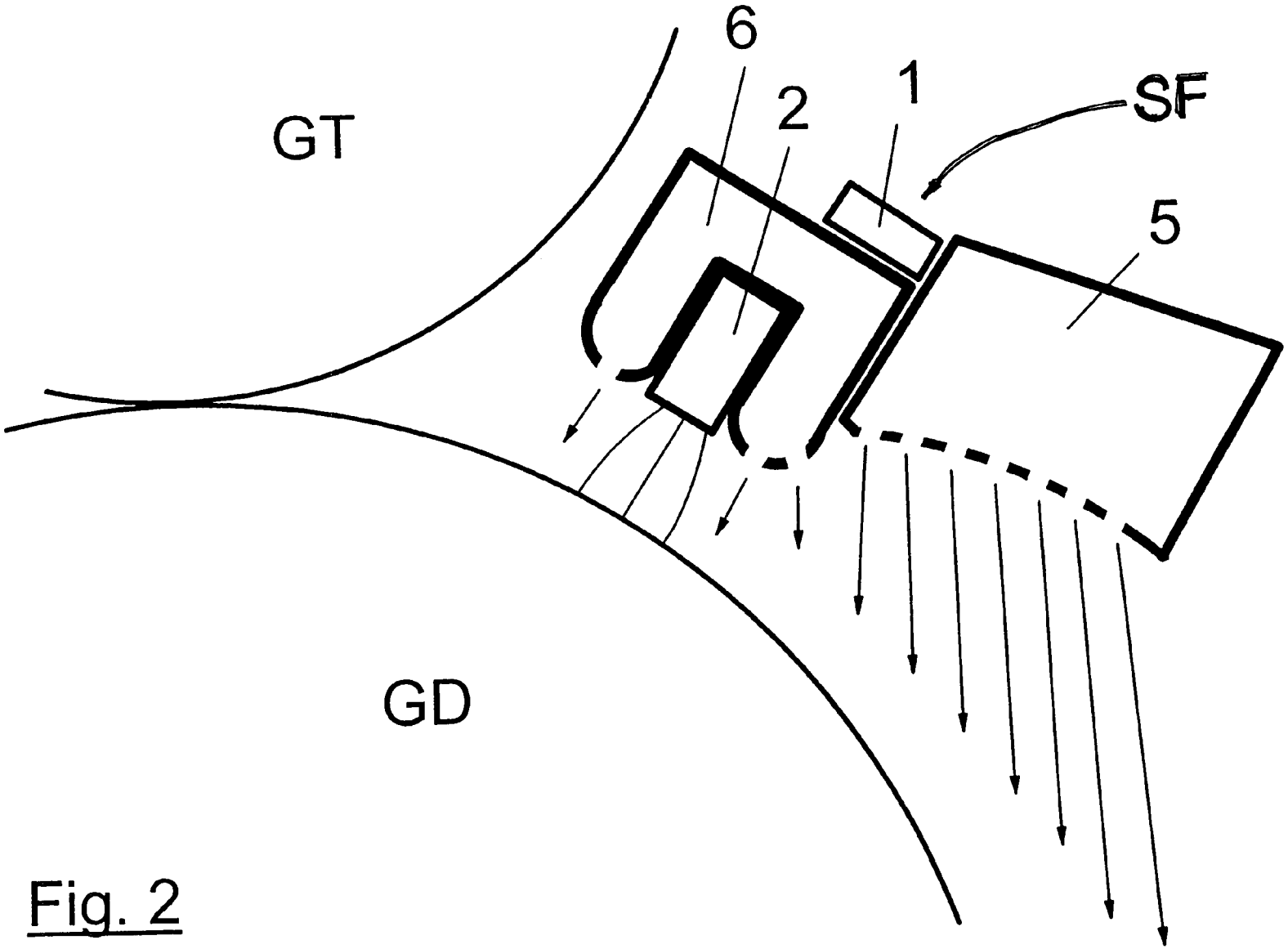
FIG. 2. is a side elevational view of an alternative embodiment of sheet fixing apparatus in accordance with the invention, which includes an electrode disposed within a hollow profile for directing pressurized air streams on opposite sides of the electrode, and an upstream air directing or blasting box.

In the further alternative embodiment shown in FIG. 2, a pair of air blasting tube-like members, generally similar to the tubes 3, 4 described previously, are defined by a common hollow profile 6, made of plastic, which further accommodates the electrode 2 in a central groove thereof. Supplying pressurized air to the hollow profile 6 causes air streams to emit from air outlet openings in the hollow profile on opposite sides of the electrode 2 which face the counter-pressure cylinder GD, as indicated by the arrows, pressing the sheet to be printed onto the counterpressure cylinder GD similar to that described above. The electrode 2 in this case is supported by the hollow profile 6 on a carrier crossbeam 1. An air blasting box 5, similar to that shown in FIG. 1, is arranged upstream of the electrode, as viewed in the sheet transfer direction.

Figure 3:
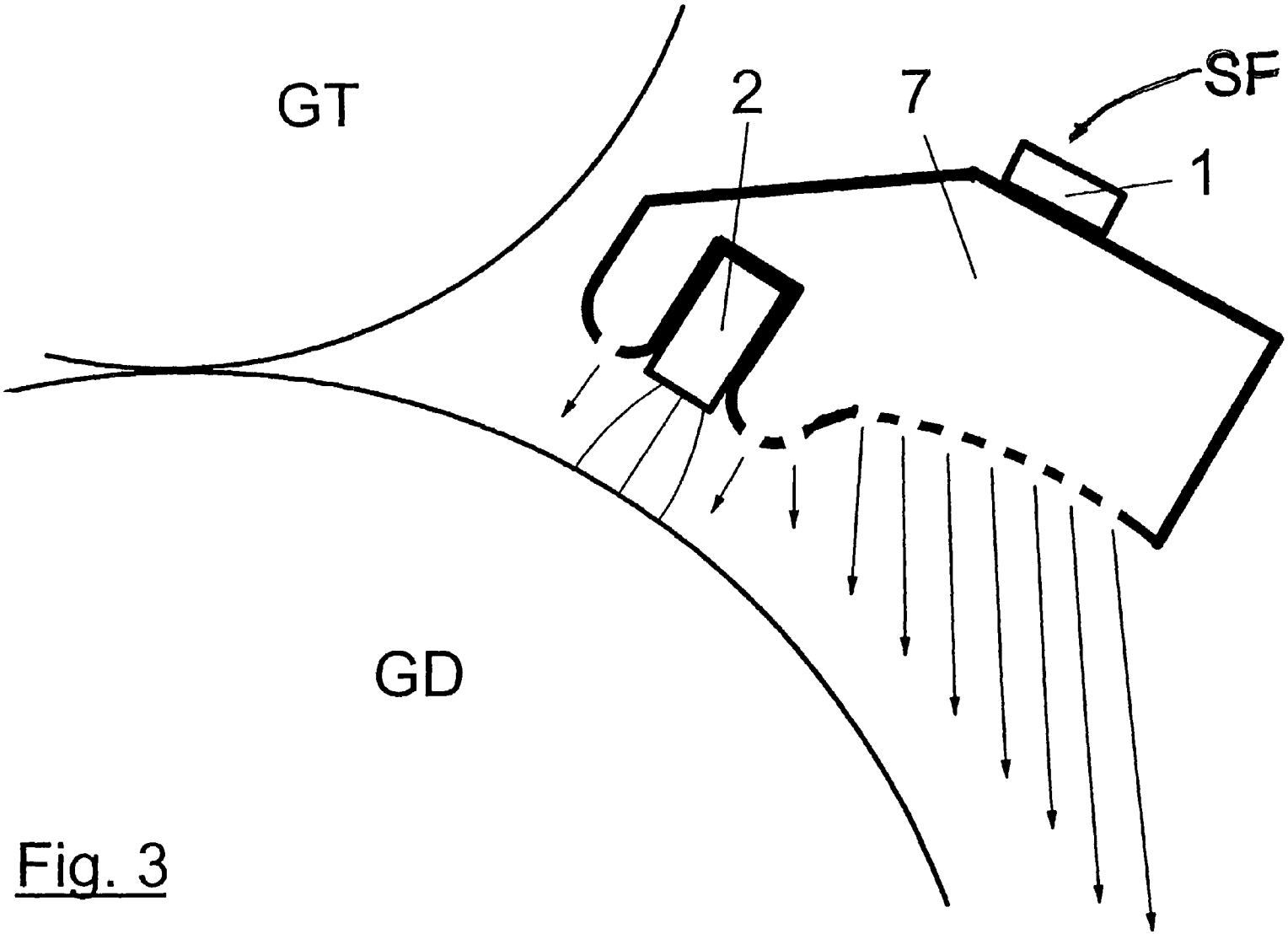
FIG. 3 is a side elevational view of still another alternative embodiment of sheet fixing apparatus in accordance with the invention in which the upstream air blasting box encompasses the electrode.

In the further alternative embodiment shown in FIG. 3, an integral blasting box 7 is provided in the form of a hollow profile arranged on a crossbeam 1. The hollow profile accommodates a rod-shaped electrode 2 in a groove-shaped region situated on the end that faces the counter-pressure cylinder GD. As in the embodiments shown in FIGS. 1 and 2, this hollow profile 7 has a concave surface in the region situated upstream of the electrode 2, as viewed in the sheet transport direction, that has a series of air outlet openings. The regions situated upstream and downstream of the electrode 2 as viewed in the sheet transport direction, are also provided with additional air discharge openings. The currents indicated by the arrows are produced when acting upon the hollow profile 7 with compressed air.

Figure 4:
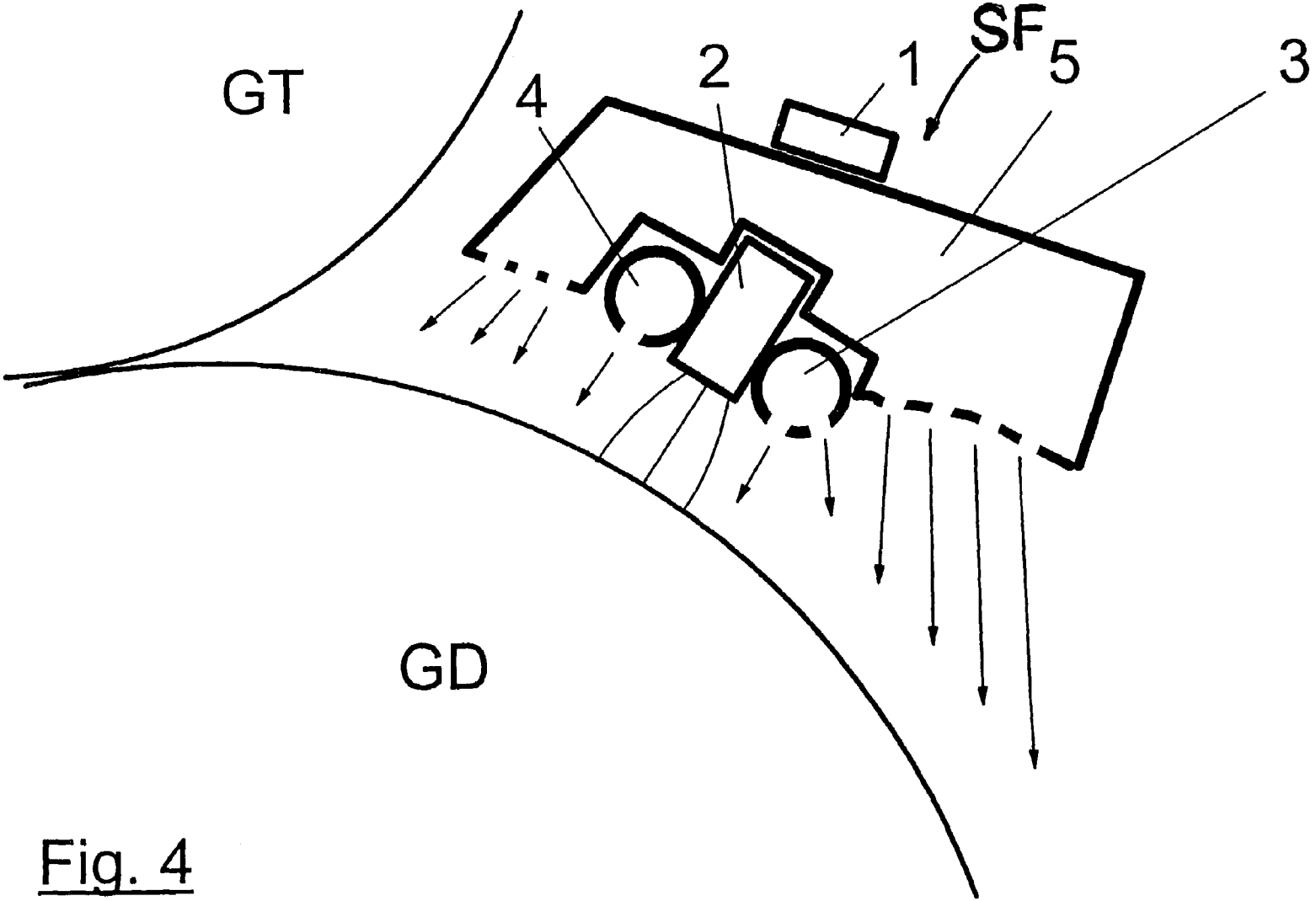
FIG. 4 shows still another alternative embodiment of sheet fixing apparatus in accordance with the invention, wherein an air directing or blasting box encompasses the electrode and a pair of air blasting tubes on opposite sides thereof.

In still a further alternative embodiment shown in FIG. 4, an electrode 2 is surrounded by two blasting tubes 3, 4. The electrode 2, as well as the blasting tubes 3, 4, are arranged in a hollow profile 8, wherein this hollow profile 8 has a concave region provided with a series of air outlet openings on its end that is situated upstream of the electrode 2, namely analogous to the embodiment shown in FIG. 3. The hollow profile 8 also has a surface with air outlet openings which lies downstream of the blasting tubes 3, 4 and the electrode 2.

What is claimed is:

1. A sheet-fed printing machine comprising at least one electrically conductive cylinder for transferring sheets in the printing machine, an apparatus for fixing a sheet on a surface of said cylinder, during transfer in the machine, said apparatus including an electrode bar having an exposed unencumbered face extending in closely spaced apart parallel relation to an outer perimeter of said cylinder that extends along the width of the cylinder for imparting an electrical charge which adheres the sheet to the cylinder as the sheet is transported between the cylinder and the electrode, and an air directing device including a first portion disposed at a location adjacent an upstreamside of said electrode bar, as viewed in the sheet transport direction, upstream of where the sheet is exposed to the electrical charge of said electrode bar for directing air currents on to the sheet to preliminarily position the sheet onto the cylinder prior to the sheet being exposed to the electrical charge of said electrode, and said air directing device including a second portion disposed at a location adjacent a downstream side of said electrode bar, as viewed in the sheet transport direction, for directing air currents onto the sheet and further stabilizing the sheet on the cylinder subsequent to being exposed to the electrical charge of said electrode, said air directing device first portion including an air blasting box in the form of a hollow profile adapted for directing air streams against a sheet upstream of the electrode and an air blasting tube having a plurality of outlet openings from which air currents are directed onto the sheet, and said hollow profile having a groove-shaped region for receiving said electrode bar and air blasting tube.

2. The sheet-fed printing machine of claim 1 in which said air directing device second portion includes second blasting tube positioned adjacent a downstream side of said electrode bar having outlet openings therein such that pressurized air directed to said second blasting tube will discharge air currents onto the sheet downstream of where the sheet is exposed to the electrical charge of said electrode bar, as viewed in the sheet transfer direction.

3. The sheet-fed printing machine of claim 1 in which said blasting box has a surface that extends in concave relation to the surface of the cylinder and which is formed with a plurality of air openings from which air currents are directed onto the sheet.

4. The sheet fed printing machine of claim 1 in which said first and second portions of said air directing device each extend a circumferential width along the perimeter of the cylinder at least three times a circumferential width of the electrode.

5. A sheet-fed printing machine comprising at least one electrically conductive backup cylinder for transferring sheets in the printing machine to a printing nip between said backup cylinder and a blanket cylinder, an apparatus for affixing a sheet on a surface of said backup cylinder during transfer to said printing nip, said sheet fixing apparatus including an electrode bar having an exposed unencumbered face extending in closely spaced apart parallel relation to an outer perimeter of said cylinder along the width of the backup cylinder for imparting an electrical charge which adheres the sheet to the backup cylinder as the sheet is transported between the backup cylinder and the electrode toward said printing nip, a first air directing device disposed adjacent an upstream side of said electrode bar, as viewed in the sheet transport direction, for directing air currents onto the sheet to preliminarily position the sheet onto the backup cylinder prior to transport of the sheet between the cylinder and electrode and a second air directing device disposed adjacent a downstream side of said electrode bar for maintaining the sheet on the backup cylinder following passage of said electrode bar, said first air directing device including an air blasting box in the form of a hollow profile adapted for directing air streams against a sheet upstream of the electrode and an air blasting tube having a plurality of outlet openings from which air currents are directed onto the sheet, and said hollow profile having a groove-shaped region for receiving said electrode bar and air blasting tube.

6. The sheet-fed printing machine of claim 5 including a second air directing device having a second blasting tube positioned adjacent a downstream side of said electrode having outlet openings therein such that pressurized air directed to said second blasting tube will discharge air currents onto the sheet downstream of where the sheet is exposed to the electrical charge of said electrode bar, as viewed in the sheet transfer direction.

7. The sheet-fed printing machine of claim 5 in which said second air directing includes a portion of said hollow plenum adapted for directing air streams against a sheet downstream of the electrode bar.

8. The sheet fed printing machine of claim 5 in which said first air directing device has a circumferential width upstream of said electrode bar at least twice a circumferential width of the electrode bar.

9. The sheet fed printing machine of claim 5 in which said first air directing device extends a circumferential distance upstream of said electrode bar about six times the circumferential width of the electrode bar.

10. The sheet fed printing machine of claim 5 in which said exposed face of said electrode bar is spaced from said cylinder a distance of between about 10 and 40 mm.

* * * * *